United States Patent [19]

Ray

[11] Patent Number: 4,681,464

[45] Date of Patent: Jul. 21, 1987

[54] TIMEPIECE MOVEMENT INCLUDING A PLURALITY OF STEPPING MOTORS AND AN ELECTRONIC TIME BASE

[75] Inventor: Claude Ray, Montezillon, Switzerland

[73] Assignee: ETA SA Fabriques d'Ebauches, Switzerland

[21] Appl. No.: 677,969

[22] Filed: Dec. 4, 1984

[30] Foreign Application Priority Data

Dec. 6, 1983 [CH] Switzerland ..... 6515/83

[51] Int. Cl.[4] ..... G04C 3/14; G04F 8/00

[52] U.S. Cl. ..... 368/157; 368/160; 368/88; 368/220

[58] Field of Search ..... 368/157, 160, 88, 220, 368/322

[56] References Cited

U.S. PATENT DOCUMENTS

| | | | |
|---|---|---|---|
| 3,884,035 | 5/1975 | Jeannet et al. | 368/76 |
| 4,262,345 | 4/1981 | Ganter et al. | 368/76 |
| 4,308,610 | 12/1981 | Walker | 368/220 |
| 4,364,669 | 12/1982 | Thoenig et al. | 368/111 |
| 4,496,246 | 1/1985 | Ota et al. | 368/220 |

FOREIGN PATENT DOCUMENTS

| | | |
|---|---|---|
| 0048217 | 3/1982 | European Pat. Off. . |
| 0083307 | 7/1983 | European Pat. Off. . |
| 2353889 | 12/1977 | France . |
| 2005875 | 4/1979 | United Kingdom . |
| 2028545 | 3/1980 | United Kingdom . |

*Primary Examiner*—Bernard Roskoski

*Attorney, Agent, or Firm*—Griffin, Branigan & Butler

[57] ABSTRACT

The base plate bears on one of its surfaces a motor for counting off current time and two motor units for counting off minutes and hours of measured time intervals. On the lower surface it bears a motor for counting off seconds of measured time and a motor for counting off hundredths of seconds of measured time, these latter being partially superposed over the motors on the other surface. A tube is placed so as to locate and guide by its outer surface the display wheel train driven by the current time motor and by its inner surface the display wheel train driven by the motors which count seconds and hundredths of seconds of measured time. Two substrates placed respectively above and below the motors are connected by contact blocks. A control circuit and a quartz resonator are fastened to the lower substrate. The battery is accommodated in a lodging adapted thereto and its thickness extends to both surfaces of the base plate. The motor units for counting off minutes and hours of measured time may be separately pre-assembled. They drive indicators placed in off-center positions on the dial.

20 Claims, 11 Drawing Figures

TIMEPIECE MOVEMENT INCLUDING A PLURALITY OF STEPPING MOTORS AND AN ELECTRONIC TIME BASE

BACKGROUND OF THE INVENTION

It is generally known that presently considerable research is taking place with the purpose of perfecting timepieces of the electronic type having an analog display, that is to say in which the display means comprises one or several hands and the movement thereby requires one or several stepping motors. In particular it is known that with the purpose of obtaining multifunctional timepieces of this type, recently there have been developed arrangements of the movement which comprise several stepping motors controlling several wheel trains.

The general constraints applicable to timepiece construction, in particular the necessity to reduce to the extent possible the overall dimensions of movements and at the same time assure the reliability of operation with as small a consumption of energy as possible, must likewise be taken into account for the construction of timepiece movements having several motors. Up to the present time to obey these constraints one has always arranged the placement of the various motors at the same level one beside the other within the movement. U.S. Pat. Nos. 4,364,399, 3,884,035 as well as the published British patent application Nos. GB 2 028 545 and GB 2 005 875 give examples of arrangements which have been considered necessary up to the present time.

At the same time a need exists for the realization of timepiece chronographs having an increased number of functions over those already known and it has not been possible to reach this result with the arrangement adopted up to the present because of the overcharging of the planar area.

SUMMARY OF THE INVENTION

It has now been observed that for cases where it is desirable to increase the number of functions, it is more preferable to introduce a different arrangement in which the motors are situated on several planes and are at least partially superposed whereby one may obtain a satisfactory distribution as much in the plane area as in the thickness. The purpose of the present invention is thus to realize a timepiece movement according to the definition of the introduction to claim 1 in which the various motors are arranged in a manner as studied as possible in order to obtain a compact and reliable arrangement.

With this purpose in hand, the timepiece movement according to the invention is such that the frame comprises two opposed support surfaces each supporting at least one of said motors and that the electric conductors for interconnecting the motors are constituted at least partially by tracks formed on two insulating substrates fixed in the frame each facing one of said support surfaces. These motors may be at least partially superposed.

Hereinafter there will be described by way of an example a form of realization of the object of the invention choosing as an example of the application the case of a movement for a chronograph watch with analog display comprising a first motor driving a wheel train for the display of current time and four additional motors controlled by a set of push pieces and driving wheel trains comprising respectively the hundredths of seconds, the seconds, the minutes and the hours of measured time intervals. Such a form of realization will be shown by the attached drawings.

DESCRIPTION OF THE PREFERRED EMBODIMENT

Figure 1:
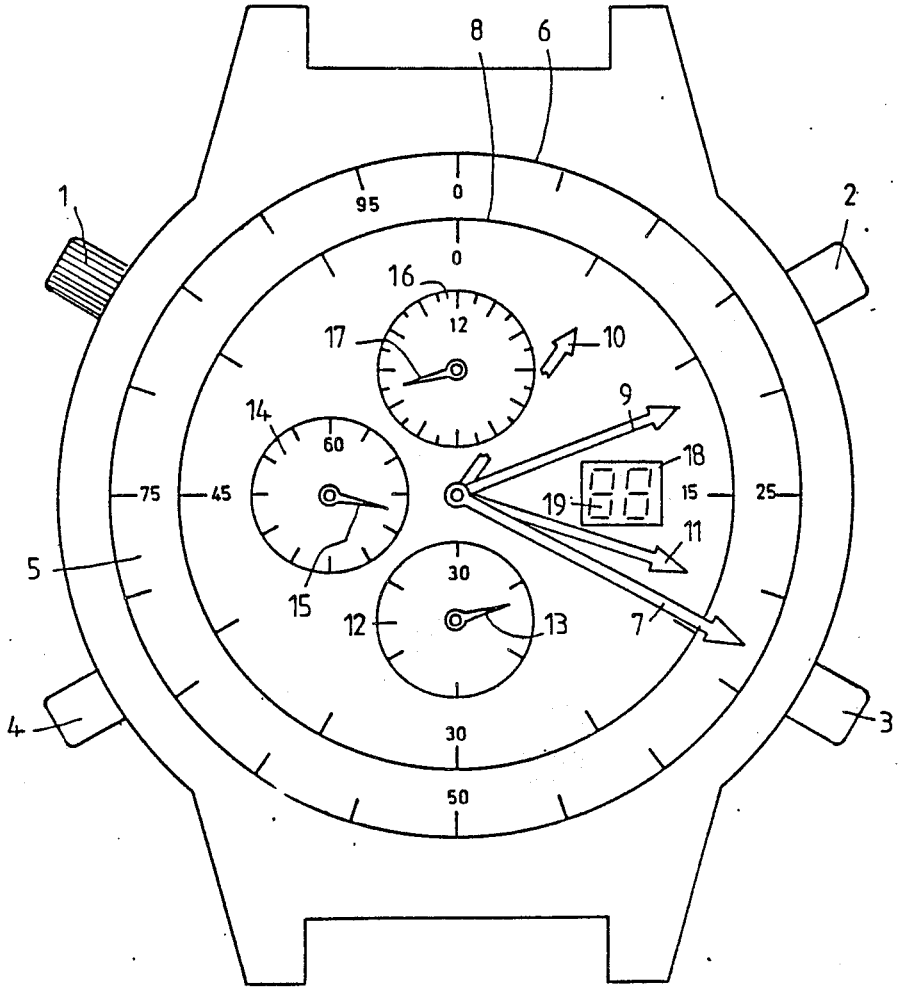
FIG. 1 is a plan view from above of the dial of the watch chronograph.

The timepiece shown on FIG. 1 is intended to be a wrist-watch chronograph. However it is well understand that the movement which is to be described hereinafter may also be constructed in a manner to be incorporated in a case adapted for a pocket watch for example or any other form of execution. FIG. 1 shows the appearance of the visible face of the watch chronograph. It is to be seen in particular that the functions may be controlled by means of four different control organs: a crown 1 and three push pieces designated 2, 3 and 4. The dial 5 comprises a certain number of graduated scales centered on the axis of the movement and three graduated scales of smaller dimensions disposed around the center. The graduated scales concentric to the movement axis comprise at the exterior a graduation in one hundred divisions designated by 6 and which permits noting the position of a hand 7 marking hundredths of a second. Closer toward the center will be found a graduated scale 8 which is divided into sixty units and enables reading the minutes of current time indicated by the minutes hand 9. This graduation may likewise serve the hours hand 10 of the current time the same graduation further being provided by indexes 1 to 12 according to the normal division. A fourth hand pivots also at the center of the dial. It is designated by 11 and enables reading the seconds of measured time intervals when the chronograph function is engaged.

The decentered graduated scales comprise toward six o'clock a circular scale divided in thirty divisions designated by 12 and over which may be displaced a hand 13.

As will be seen further on, this hand is for counting minutes and is displaced when the chronograph is engaged. Proximate nine o'clock there will be found a graduated scale 14 and a hand 15. This hand is a small seconds hand. It, accordingly, operates continuously and is driven by the time counting mechanism for current time as will be seen further on. At twelve o'clock, will be found a graduated scale 16 divided into twenty-four parts over which is displaced a hand 17. This hand serves to count hours and half-hours of measured time intervals and operates only when the chronograph function is engaged.

Finally dial 5 includes an opening 18 in which appear two display positions of a digital display cell employing liquid crystals and designated by 19. As will be seen further on, this cell is controlled by the arrangement for counting current time and indicates the date when the chronograph is not operating. It may fulfil other functions when the chronograph is engaged, for instance to indicate the order of memorization of the measured times.

Thus the different functions of the watch chronograph appear clearly in FIG. 1. It is in a fact a timepiece which indicates current time in the form of seconds, minutes and hours in the analog form by means of hands normally disposed at the center of the dial for the hours and the minutes and displaced toward nine o'clock for the seconds. Moreover the measurement of current time includes a calendar function in digital form by a liquid crystal cell.

As far as the chronograph functions are converned two central hands indicate the measurement of seconds and hundredths of seconds while the two hands displaced respectively toward six o'clock and twelve o'clock indicate minutes and hours of the periods of measured time and the liquid crystal cell will indicate on this occasion the order of the memorized times. Further it may be noted that the time setting of current time is obtained by means of a conventional setting stem which may be axially displaced between three positions, that is to say a rest position and two control positions one of which enables displacement of the hands by rotation thereof. Moreover the three push pieces 2, 3 and 4 assure the functions of start, stop and return to zero of measured time intervals. As will be seen further on, the hand for measuring hundredths of seconds is not displaced except at the moment when the user operates the stop push piece for measured time. It will then be brought to a position corresponding to the fraction of a second which has been measured by a counter forming part of the electronic circuitry. At the instant of operation of the function return to zero all hands employed for the measurement of time intervals will be brought to the normal zero position.

In the movement described herein, each of the four hands for measurement of time intervals is driven by a different stepping motor. The movement comprises thus four motors for the measurement of time intervals as well as a motor for the counting of current time this latter motor driving a conventional wheel train.

The particular feature of the movement resides in the fact that the motors are placed on two opposite support surfaces in a manner such that at least two motors may be directly superposed, this permitting a construction of reduced surface area.

Figure 2:
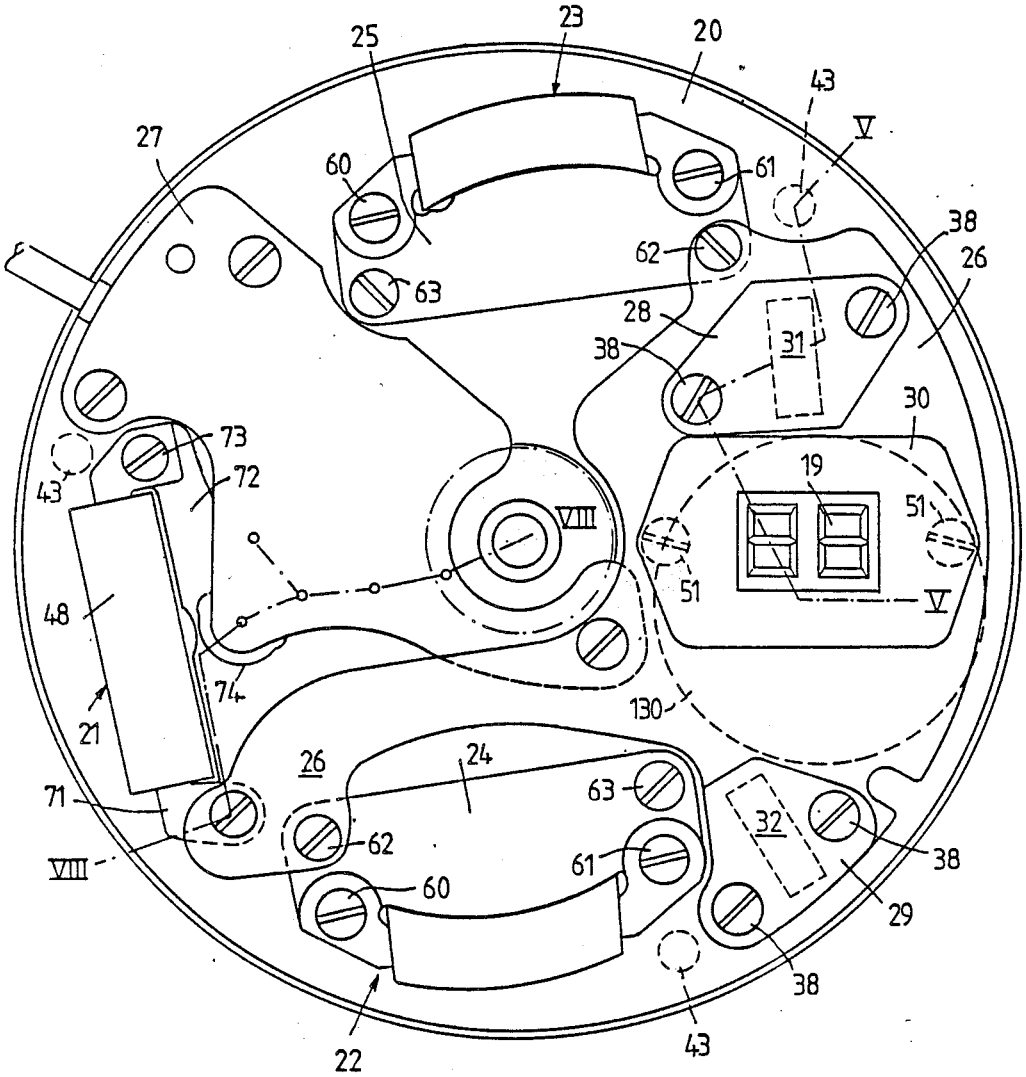
FIG. 2 is a plan view from above at an enlarged scale showing the movement following removal of the dial and of an upper magnetic screen element.
Figure 3:
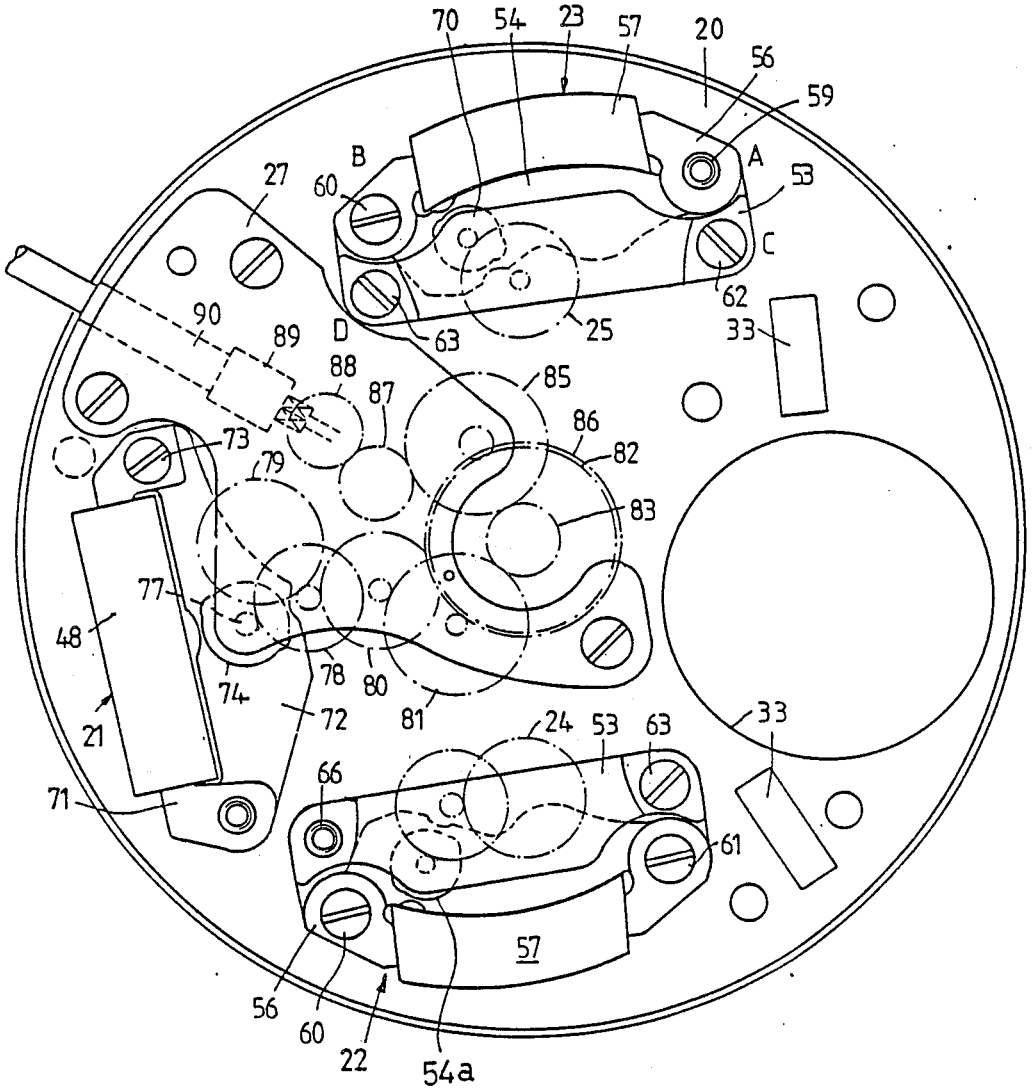
FIG. 3 is likewise a plan view from above showing the same movement after the substrate of the upper printed circuit has been also removed.
Figure 4:
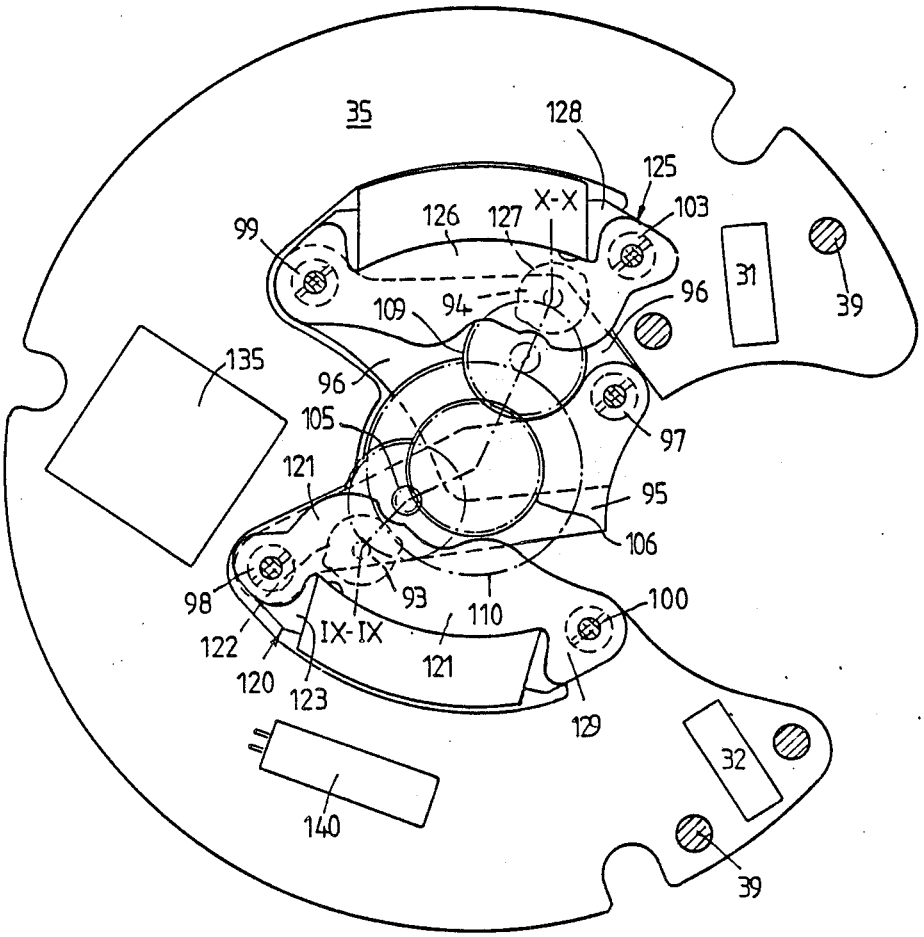
FIG. 4 is a plan view likewise from above showing the lower part of the movement after removal of the base plate.
Figure 11:
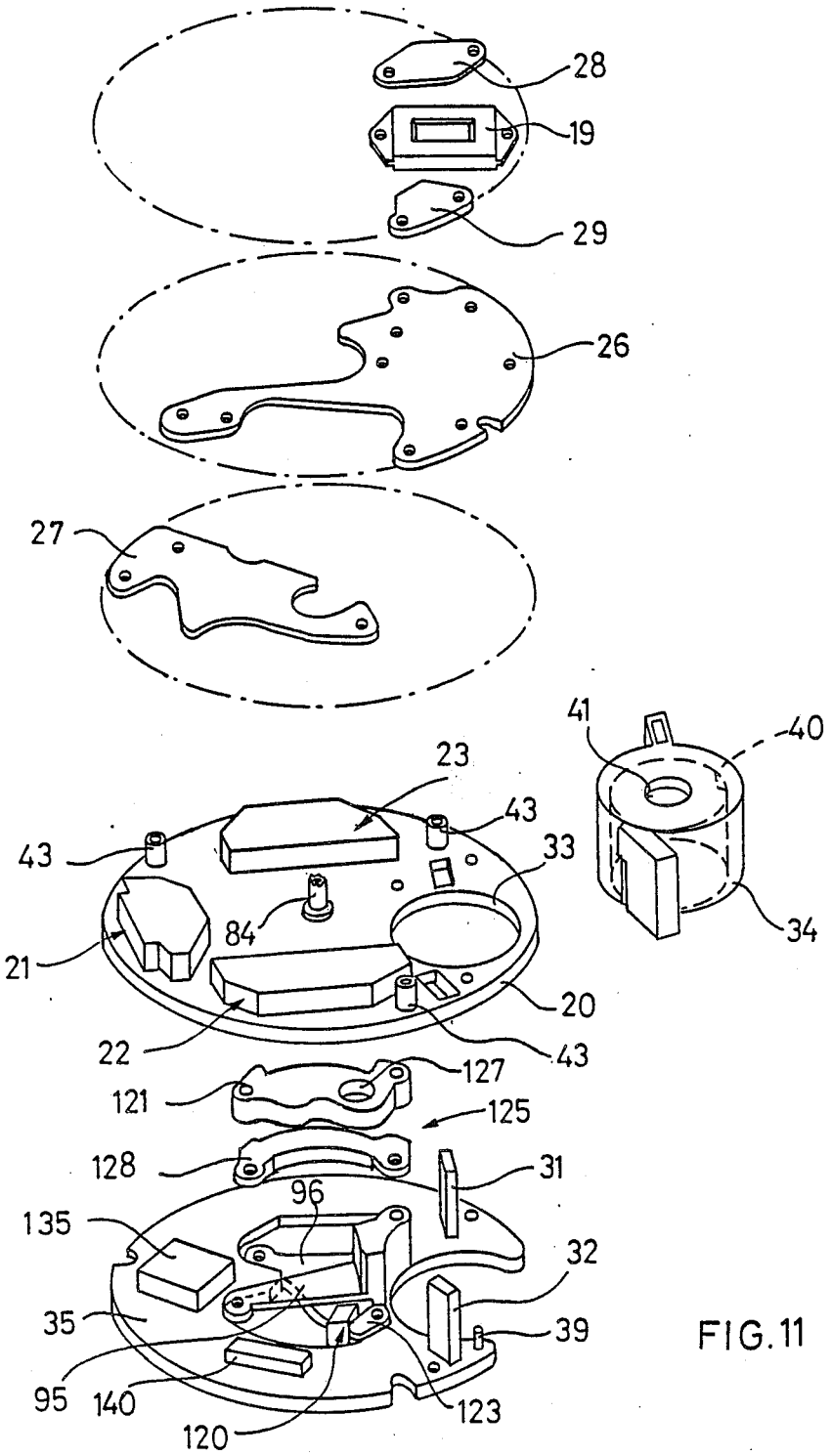
FIG. 11 is an exploded perspective view showing the superposition of the several elements of the movement.

FIGS. 2 to 4 as well as FIG. 11 show how the frame of the movement has been conceived and how the principal organs assuring the described functions may be disposed. The principal element of the frame is a base plate 20 of circular form, shown on FIG. 2 for instance. On this base plate are mounted a motor 21 which drives the wheel train for current time, a motor unit 22 and a motor unit 23. As will be seen further on, the motor units 22 and 23 are autonomous blocks each comprising a stepping motor, a wheel train and two bridges enabling pivoting of the wheels within the wheel trains. The motor unit 22 assures counting minutes of measured time while the motor unit 23 counts hours of measured time. As will be seen on FIG. 3, motor unit 22 comprises an indicator wheel 24 off centered toward six o'clock. This is the wheel the axis of which bear hand 13 while the motor unit 23 includes an indicator wheel 25 decentered toward twelve o'clock the axis of which bears the hand 17. The motor 21 as well as units 22 and 23 are partially covered by an insulated substrate 26 (FIG. 2) which bears conductive tracks. To one side and partially under this substrate is fastened a wheel train bridge 27. On the substrate are to be found two upper support plates 28 and 29 and a framing plate 30 which holds in place the display cell 19.

Figure 10:
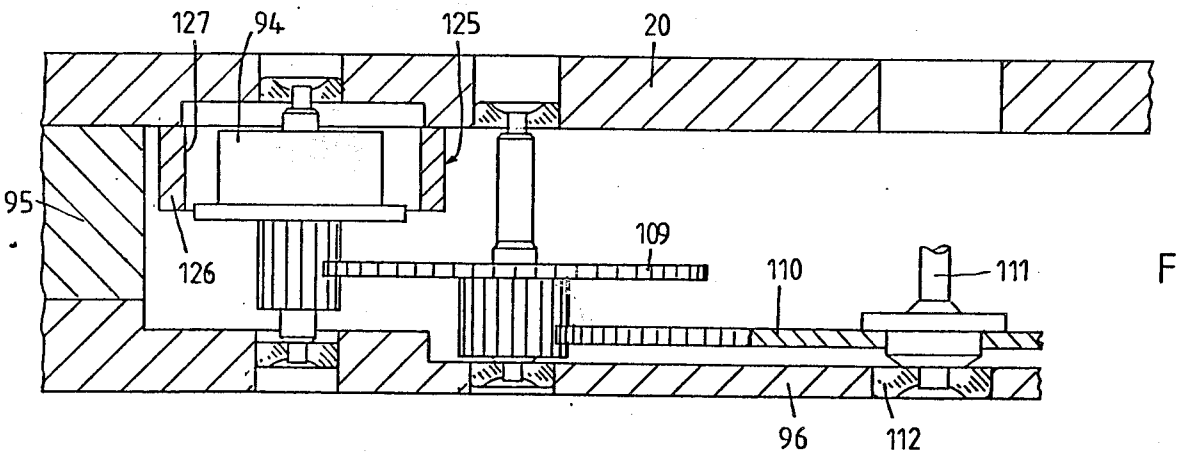
FIG. 10 is a partial sectional elevation across the lower part of the movement according to the line X—X of FIG. 4.

The motors and wheel train elements assuring the counting of measured seconds and hundredths of seconds are fastened under the base plate 20 as subsequently explained with reference to FIG. 10. Below these motors extends a second insulating substrate 35 bearing printed tracks (not shown) and this second substrate itself bears the electronic control circuit 135 (FIG. 1), that is to say the integrated circuit chip as well as the quartz oscillator which constitutes the time base of the timepiece as described. On the other hand, the two printed circuit substrates are coupled to one another through the base plate as by blocks of conductive foils assembled by means of insulating material. Such blocks are known in commerce as zebra connectors and will not be described in detail herein. They are shown in FIGS. 2 and 11 where they are designated by reference numbers 31 and 32. The support plates 28 and 29 as well as similar plates placed under the lower printed circuit substrate 35 permit pressing the printed tracks on the internal or facing surfaces of the substrates against the ends of the conductive foils of the blocks 31 and 32 which assures transmission, on one hand, of the control pulses for the motors situated above the base plate and, on the other hand, the control pulses for the cell 19 and control pulses supplied by the push pieces 2, 3 and 4.

As will be seen further on the energy source of the movement, which is constituted by the usual battery, as well as the two blocks 31 and 32 are embedded in a support block of insulating material 34 (FIG. 5 and FIG. 11) which itself is engaged in an aperture 33 in the base plate and which so as project over the two surfaces of the base plate.

Figure 5:
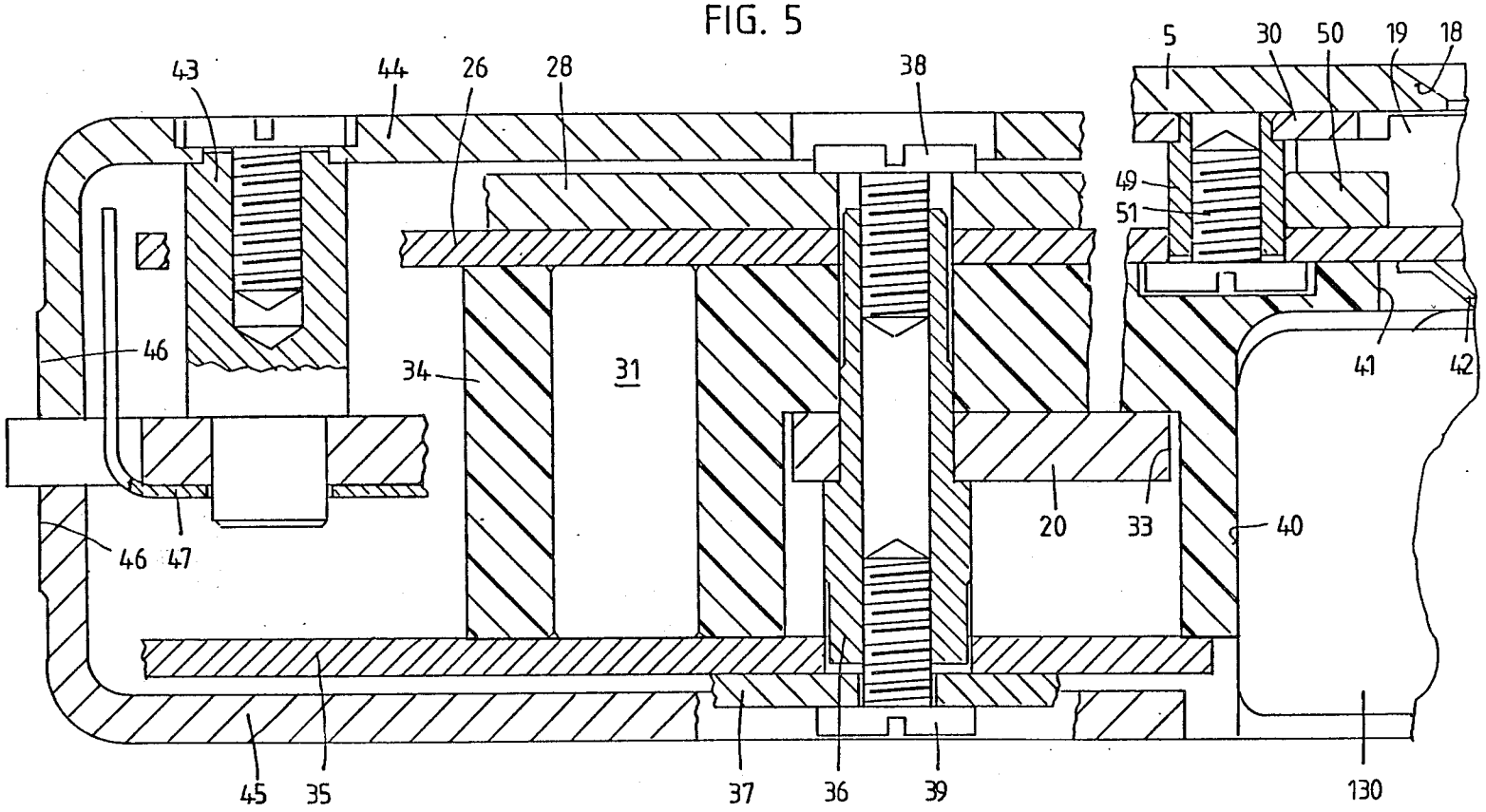
FIG. 5 is a sectional elevation according to a broken line marked V—V on FIG. 2, this cross section being at a greatly enlarged scale.

FIG. 5 which is a sectional elevation in accordance with line V—V of FIG. 2 likewise illustrates this arrangement. On this figure there will be recognized the bas plate 20 with the aperture 33 in which is engaged the projecting portion of block 34. One of the coupling blocks 31 is likewise visible in FIG. 5 as well as the upper substrate 26 and the lower substrate 35. Four pillar supports 36, pressed into openings in the base plate 20 extend upwardly and downwardly and penetrate into holes provided respectively in the upper substrate 26 and the lower substrate 35 as well as in the upper support plate 28 and the corresponding lower support plate 37. Screws 38, 39 enable pressing together the support plates and the substrates on either side of block 34 this assuring the connection between the foils of the conductive blocks 31 and 32 and corresponding tracks onthe substrates 26 and 35 and on the other hand the rigidity of the substrate assemblies relative to the base plate. It will be further seen on FIG. 5 that the support block 34 includes in its lower surface a lodging 40 in which is placed a battery 130. On its upper portion block 34 includes an opening 41 through which a blade 42 fixed to the internal surface of substrate 26 may penetrate and come into contact with the negative pole of the battery. The connection between the lower pole of the battery and substrate 35 has not been shown on the drawing. It comprises a blade similar to blade 42 fixed onto the outer surface of substrate 35 assuring thus the positive contact.

The base plate 20 comprises still other support pillars such as pillars 43. These pillars, three in number, are distributed about the periphery of the base plate as may also be seen in FIG. 2. They enable fastening shielding caps 44 and 45 above and below the movement. As shown in FIG. 5, the lateral walls of these shielding caps are brought to bear on the upper and lower surfaces of the base plate the edge of which extends to the exterior of these caps in a manner to enable support thereof within the watch-case. At the same time the caps 44 and 45 each exhibit a cylindrical machined surface 46 which serves to center the movement in the interior of the case. The functions of the support pillars 43 likewise consist of guiding and maintaining in place the conductive foils such as the foil 47 which are bent upwards and extend to face the tracks on the section of substrate 26. It will be noted that the foils correspond to the push pieces 2, 3 and 4. They are displaced toward the center by operation of the push piece so as to ground the track borne by the substrate opposite their end. In order to assure fastening of foils 47 screws are provided in the base plate which are not shown on the drawing.

FIG. 5 further shows mounting of the digital display cell 19 on substrate 26. The framing plate 30 provided with threaded tubes 49 and a contact arrangement 50 likewise of the zebra type sandwich the periphery of cell 19 while screws 51 engage in threading of tubes 49 to squeeze the assembly against the substrate 26. As well understood, the upper surface of the substrate will exhibit the necessary number of conductive tracks in order to control the two display positions each of seven segments thus permitting display of all the digits from zero to nine. Dial 5 extends above the shielding cap 44 and one sees in section the form of the edges of the opening 18 on FIG. 5.

Figure 6:
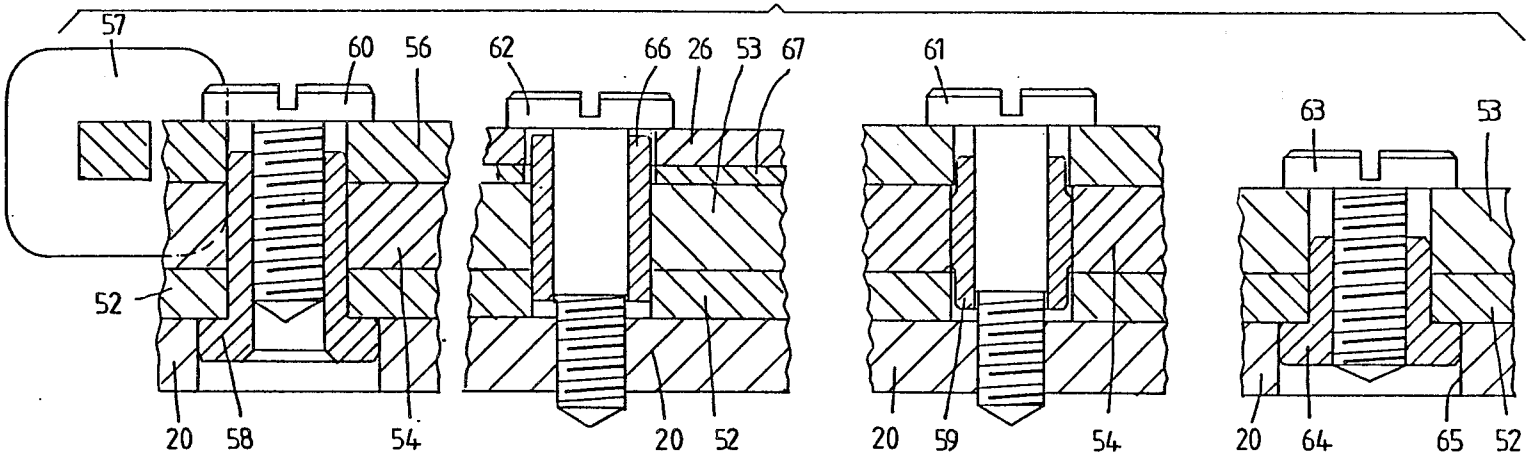
FIG. 6 is a sectional elevation to the same scale as FIG. 5 showing four portions of a counting unit.
Figure 7:
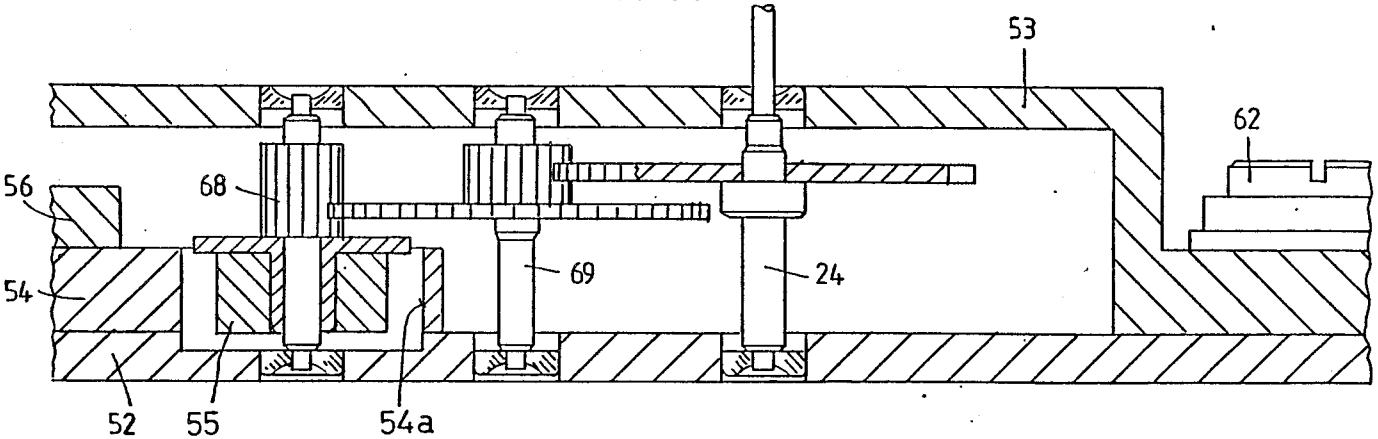
FIG. 7 is a sectional elevation similar to FIG. 6 showing other elements of the same counting unit as FIG. 6.

Before going on to the description of the current time wheel train and its control mechanism, the motor units 22 and 23 will be described having reference to FIGS. 3, 6 and 7 and based on unit 22 which, as has been said, serves for counting the minutes of measured time. This unit comprises a unit base plate 52 which is supported directly on base plate 20. On base plate 20 is preassembled a unit bridge 53 which as will be seen in FIG. 7 is milled below and above in a manner to provide a flange at its two extremities and a raised portion between said extremities. At the side of bridge 53 the unit base plate 52 further bears a motor stator 54 which is formed from high permeability magnetic material cut out in an elongated form and providing openings, particularly a circular hole 54a with two notches in its edge arranged to surround the rotor 55 of the motor. Finally, above the stator 54 is placed the core 56 of which the central portion having a square cross section goes through winding 57 while the two end flanges provide holes in which are placed guiding and centering members 58 and 59 one of which is threaded and serves to fasten both the core and the stator to the unit base plate 52 by means of a screw 60. Another screw 61 slides without play in the guide member 59 and assures one of the fastening of the pre-assembled unit 52 onto the base plate 20.

The unit 22 further comprises two screws 62 and 63. Screw 63 is engaged in a guide socket 64 and serves simply for the assembly of the unit bridge 53 to the unit base plate 52 while the head of the guide socket 64 is engaged in a hole 65 of the base plate 20 so as to assure positioning of the unit block. As shown in FIG. 6, the fourth screw 62 slides without play in a guide socket 66 and traverses not only the flange of the unit bridge 53 and unit base plate 52 while screwing into the base plate 20 but additionally its head presses on a lateral projecting portion of the substrate 26 and on an interposed plate of substrate 67 mounted between the flange of the unit bridge 53 and substrate 26.

Thus unit 22 may be mounted as an independent block thanks to screws 60 and 63 engaged in sockets 58 and 64. Next, this block may be put into place on one of the sides of base plate 20 oriented by the socket heads 58 and 64 which are engaged in calibrated holes of the base plate and fastened by screws 61 and 62 which definitely assure the fastening of the members of the unit. Furthermore, screw 62 presses the tracks of the circuit on substrate 26 against those of the plate 67 thus connecting the motor to the circuit.

Screws 60, 61 and 63 may be seen in FIG. 3. Although substrate 26 is not shown on this figure it will be clear that plate 67 which extends over a clear portion of bridge 53 may bear two separated tracks on each of which may be soldered one of the ends of the wire of winding 57. Each of these two tracks comes into contact with a distinct track marked on the substrate 26 when this latter is put into place and fastened by screw 62. The screw 62 and the socket 64 serve moreover for positioning the unit on the base plate 20 while screw 60 serves for positioning the assembly of the stator core of the motor onto the unit 22 base plate 52 and screw 61 for fastening the pre-mounted unit to base plate 20.

FIG. 7 shows the unit in cross section according to a line passing through the center of the different wheels driven by the motor. On this figure will be seen stator 54 of the motor and its core 56. The rotor 55 pivots between the unit base plate 52 and bridge 53 in the usual bearing stones. The rotor pinion 68 drives an intermediate wheel unit 69 of which the pinion itself drives the indicating wheel unit 24 which is provided with an elongated shaft traversing not only bridge 53 but further the entire space between this bridge and the dial in a manner to bear at its end the hand 13 counting the minutes. By using stepping motors of which the rotor effects a half-turn at each step and in providing in the unit 22 a reduction with an intermediate wheel unit it is a simple matter to control the minutes counting hand in a manner such that it effects a complete rotation in thirty minutes for which reason the graduated scale 12 on dial 5 bears a graduation of thirty minutes. While the motor unit 22 comprises in its wheel train an intermediate wheel unit between the rotor pinion and the indicating wheel unit in the motor unit 23 by contrasting the indicating wheel unit is directly engaged with the rotor pinion. At the same time, according to the desired reduction ratio, the motor unit 23 might be conceived in a manner identical to that of unit 22.

The arrangement which has just been described for the two units 22 and 23 for counting minutes and hours of measured time has the advantage that these two units may be manufactured in an independent manner and employed in different calibers. Thus, nothing prevents mounting of a pair of motor units 22 and 23 on base plates of different dimensions, the axes of the indicating wheel units 24 and 25 being placed along the axis six o'clock - twelve o'clock separated more or less from the center. If so desired, in variants, one might likewise place the units in a manner such that the axes of the wheels 24 and 25 are located on other principal axes of the base plate, for example one of these axes could be located at three o'clock in the case where the watch would not include the digital display cell 19.

As concerns the construction of the motors of the two units 22 and 23, it is seen (FIG. 3) that there has been chosen a realization with cores 56 having a slightly arcuate form, the windings being wound directly on the cores and thus presenting likewise an arcuate form. The motors for the two units 22 and 23 may be exactly the same. In the realization as described all motors are unidirectional. The motors are driven in the sense of rotation which effects clockwise displacement of the indicating organ by steps the duration of which corresponds to the time period which is to be counted. For return to zero, each motor will receive a number of pulses corresponding to the difference from zero in its sense of rotation but at a much higher frequency than the counting frequency, for example at 32 Hz.

Figure 8:
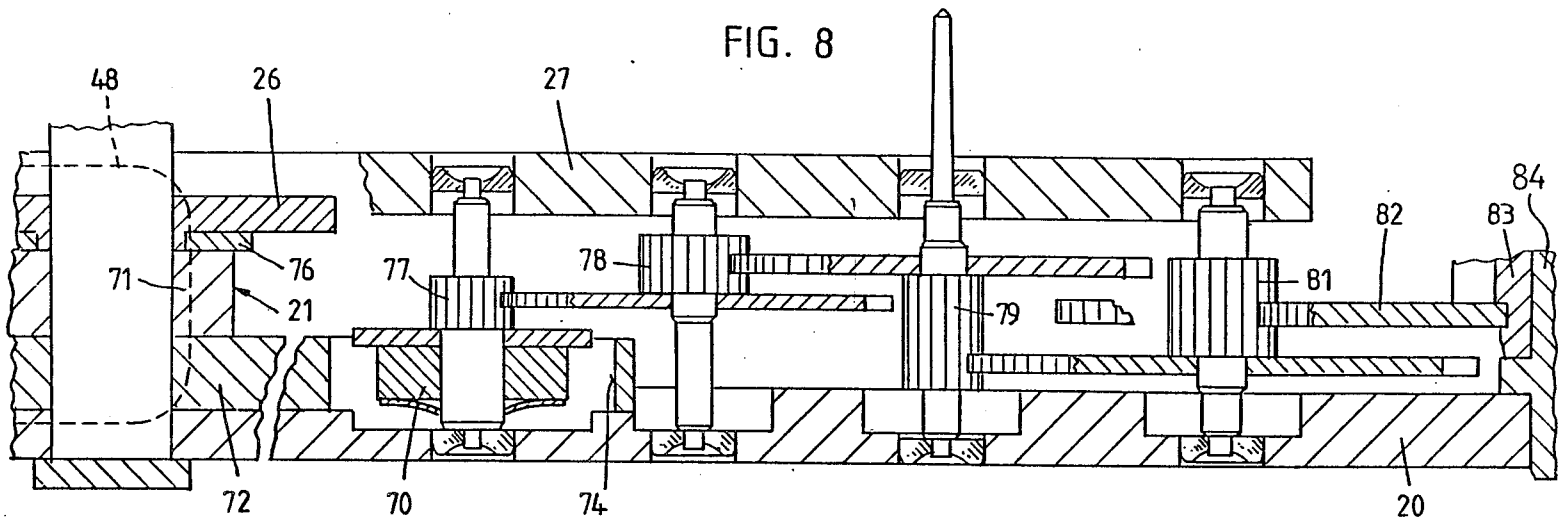
FIG. 8 is a sectional elevation according to the line VIII—VIII of FIG. 2 showing the counting wheel train for current time.

As has been previously said, the arrangement for counting current time is borne on bridge 27 visible in FIG. 2 and likewise shown on FIGS. 3 and 8. The elements of this counting arrangement are visible in a more detailed manner on FIG. 3 from where it will be seen they occupy a sector comprised between the center of the base plate 20 and the region included between the orientations of eight o'clock and ten o'clock. On FIG. 8 will be seen certain elements of this arrangement in cross section and it will be likewise seen that the counting motor 21 and the wheel train which are to be described hereinafter are mounted directly on base plate 20. The motor 21 comprises a rectilinear winding 48 placed on a rectilinear core 71 the flanges of which are placed on the extremities of the stator 72, one of these flanges being itself covered over by a limiting part of substrate 26 while the other is directly placed on the stator by a screw 73 (FIG. 2) which traverses the stator and is fixed into the base plate 20. The contour of bridge 27 extends around the elements of the motor. It covers the stator 72 only in the zone of the opening 74 provided for accomodation of the rotor 70 in order to assure the pivoting of the upper extremity of this rotor. A plate of the insulating substrate 76 is interposed between the upper substrate 26 and the flange of core 71. As has been explained for units 22 and 23, this substrate plate serves as a connection terminal between the tracks of substrate 26 and the ends of the wire of winding 48. These two ends in effect are connected by soldering to two printed tracks on plate 76. The rotor 70 bears a pinion 77 which meshes with the gear of a first intermediate wheel unit 78. The pinion of this intermediate wheel unit meshes with the gears of two similar wheel units designated 79 and 80 on FIG. 3. Wheel unit 79 is located as will be seen on FIG. 3 on the axis three o'clock - nine o'clock and as will be seen on FIG. 8 comprises an elongated shaft intended to bear the small seconds hand 15. The wheel unit 79 is thus driven in a manner such that hand 15 turns through an angle at 6° of each step, the motor 21 receiving pulses at intervals of one second. Wheel unit 80 which on FIG. 8 is mingled with wheel unit 79 is arranged as may be seen on FIG. 3 between the intermediate wheel unit 78 and a third intermediate wheel unit 81, the pinion of which meshes with a classic center wheel 82.

The arrangement of the center of the movement will be described further on. It will nevertheless be noted that the center wheel 82 is frictionally mounted on a center pinion 83 which pivots on a tube 84 fixed into base plate 20 at the center of this latter. On the other hand, as will further be seen in FIG. 3, a minute wheel 85 is provided between the center pinion 83 and a hour wheel 86 and this minute wheel 85 itself is engaged by a train of two intermediate setting wheels 87 and 88 of which setting wheel 88 may be brought into contact with the teeth of sliding pinion 89 mounted on the time setting stem 90 bearing crown 1 as shown on FIG. 1. The setting mechanism of the counting wheel train for current time is a classic type mechanism for which no further description should be necessary. By drawing the crown 1 toward the exterior, the sliding pinion 89 is displaced through the intermediate mechanism of a trigger piece and rocking lever so as to come into engagement with the setting wheel 88. Stem 90 and sliding pinion 89 are mounted between bridge 27 and base plate 20 and it is not necessary to describe such mounting in detail.

As will be seen further on when the arrangement of the movement center is described, the hour cannon wheel 86 bears the hand indicating hours of current time 10 but moreover serves to control switching of the date in the liquid crystal cell 19. For this it controls once per revolution the engagement of a switch contact blade to ground a track arranged on the upper surface of substrate 26, which every other time enables the transmission of a switching pulse to cell 19 by means of the electronic circuit developing the control signals.

Figure 9:
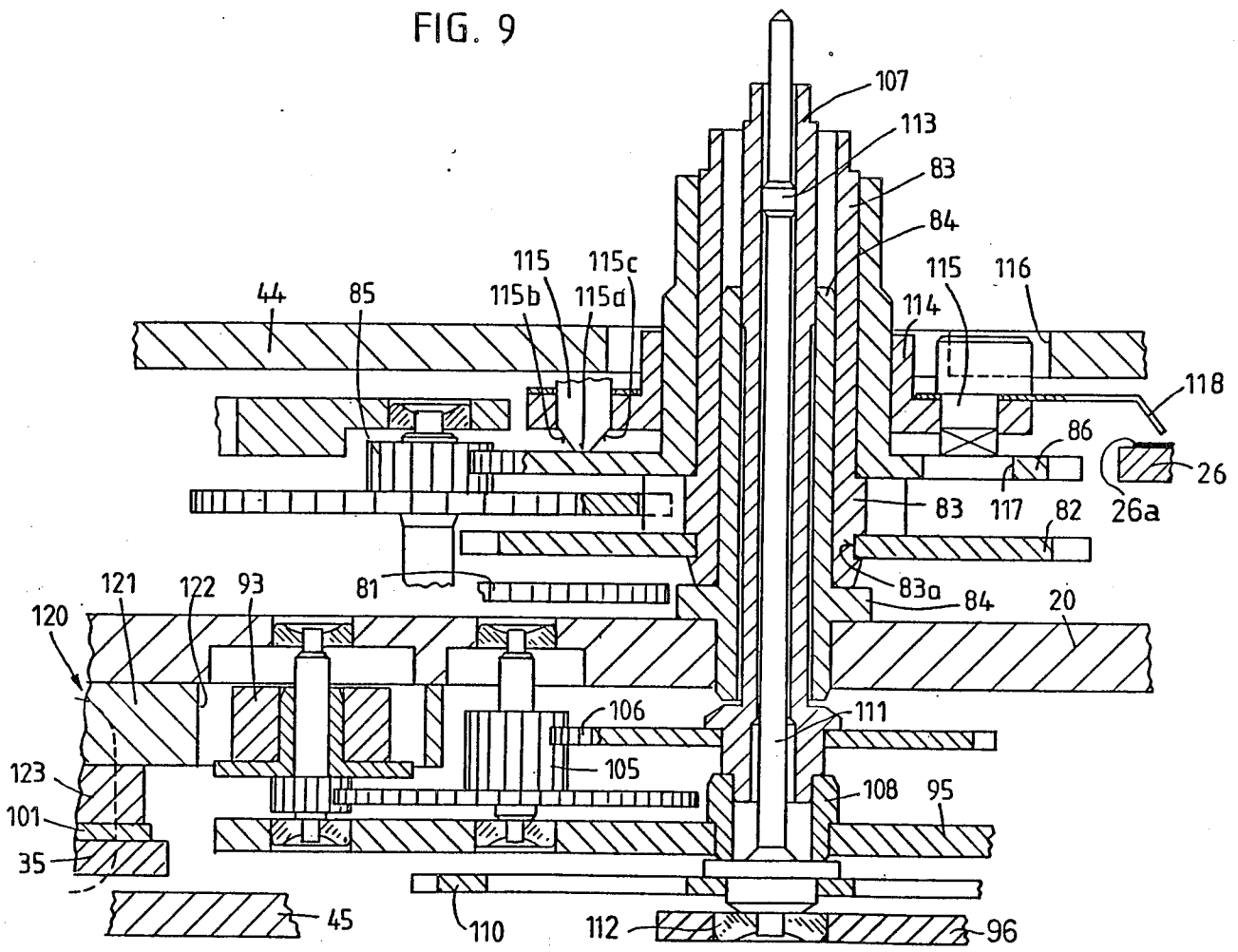
FIG. 9 is a sectional elevation taken across the entire thickness of the movement according to the line IX—IX of FIG. 4.

Before reverting to the arrangement of the center, it will be preferred to describe further the elements which are found under the base plate. Reference is made to FIG. 4 as well as FIGS. 9 and 10.

On FIG. 4 will be noted the lower insulating substrate 35 which is in the form of an arc of a circle surrounding the center. As has been previously said, this substrate is maintained in place by screws 39 engaged in support pillars 36 (FIG. 5) and the surface of the substrate visible in FIG. 4 is the interior surface thus that which is supported against the zebra contacts 31 and 32. This substrate which is likewise supported by a rigid plate 37 bears the electronic circuit 135 for developing the control signals and which is an integrated circuit chip manufactured in the usual manner fixed onto the upper surface of the substrate i.e. the side toward the interior of the movement. The various output terminals are connected by wires soldered to the various tracks provided to conduct the signals to the members to be controlled such as the motors and the display cell. The quartz 140 constituting the time base is likewise shown in schematic fashion on the upper surface of the substrate 35. Also seen on FIG. 4 are the connection blocks 31 and 32 which transmit the pulses to the tracks borne by the upper substrate 26. As in the case of motor 21, the motors 120 counting seconds of measured time intervals and 125 counting hundredths of seconds are arranged under the base plate and comprise a stator (121,126) which is directly fixed against the corresponding surface of the base plate and the core which bears the winding and which is separated from the base plate by the thickness of the stator. These motors are partially superposed on, or overlap the motor units 22 and 23. That is, a straight line may be drawn perpendicular to the plane of FIGS. 3 and 4 to extend through some part of motors 22 and 120 or motors 23 and 125. The stators 121 and 126 of these motors appear on FIG. 4 where will be noted in particular the apertures 122 and 127 provided for rotors 93 and 94 of the motors. Two bridges 95 and 96 are coupled respectively to motors 120 and 125 and support the wheel trains driven by these motors. The bridge 95 for the seconds counting arrangement is closer to the base plate than the bridge 96 which is at the lower level of the movement, that is to say at the level of the lower cap 45. Bridge 96 is lodged effectively in an opening of this cap. As may be seen on FIG. 10, the two bridges 96 and 95 are superposed and supported against the lower surface of base plate 20. A screw 97 assures a fastening in common. Bridge 95 is fastened on the other hand by a screw 98 which successively traverses core 123, then the stator 121 of the motor 120 and is finally engaged in the base plate. For its part, bridge 96 is likewise fastened by a screw 99 which successively traverses the core 128 and the stator 126 of the motor 125 and penetrates the base plate. A screw 100 further assures the fastening of core 123 and of stator 121 of the motor 120 against the base plate. This screw likewise traverses the lower substrate 35 (FIG. 9), its head bearing against the lower face of the substrate and this screw presses a plate of substrate 101 between the substrate 35 and the core 123 in a manner to connect the tracks of substrate 35 to the wires of the winding of motor 120. In the same manner, a screw 103 successively traverses substrate 35, a plate (not shown) corresponding to plate 101, the core 128 of motor 125 and the stator 126 of this motor.

Rotor 93 of motor 120 through its pinion drives an intermediate wheel unit 105 of which the pinion engages the counting wheel unit 106 for seconds of measured time intervals. As may be seen on FIG. 9, this wheel unit is arranged at the center of the movement under the base plate and comprises a hollow shaft 107 provided at its upper extremity with an enlarged diameter portion which is adjusted to the internal diameter of tube 84 fixed in the center of the base plate. The lower extremity of the hollow shaft 107 is guided by means of a bushing 108 fixed into bridge 95.

As for rotor 94 of motor 125, this engages by its pinion the gear of an intermediate wheel unit 109 (FIG. 10) the pinion of which in turn engages gear 110 of a counting unit for hundredths of a second. This arrangement comprises moreover a shaft 111 rigidly fixed to the wheel 110 of which one extremity is supported by a jeweled bearing 112 placed on bridge 96 opposite the center of the base plate while the other extremity is elongated and traverses the bushing 108 and the hollow shaft 107. At its upper extremity, this shaft 111 is provided with an enlarged portion 113 assuring the guiding thereof within the bore 107.

Thus, the arrangement of the center of the movement has been described as far as concerns elements arranged under the base plate. At its upper extremity, the shaft 111 bears the hand 7 employed for indicating hundredths of a second while the hollow shaft 107 bears the hand 11 for indicating seconds of measured time intervals.

On its external surface, the fixed tube 84 placed at the center of the base plate 20 guides the center pinion 83 the tube of which extends to just above the dial and bears the hand 9 for indicating minutes of current time. This center pinion 83 exhibits at its lower extremity a groove 83a in which is frictionally engaged the center wheel 82 as has been previously mentioned. The minute wheel 85 is likewise visible in FIG. 9 although it is not in the plane of the drawing. It pivots in bridge 27 which as has been seen in FIG. 2 provides proximate the center an opening surrounding the space comprised between the surface of the hour wheel 86 and the central aperture of the upper shielding cap 44. A final mobile unit is placed in this space, the unit comprising an annular cam 114 (FIG. 9) which pivots around the cannon of the hour wheel 86. A spring blade in the form of a foil bias spring or which might be directly a portion of the contact blade 118 supported either under the dial or under the cap 44 urges the lower angular planar portion of this cam 114 against the surface of hour wheel 86. Three studs 115 are fixed in the surface of cam 114 in positions spread apart at 120° in a manner to extend beyond the lower and upper surfaces. The portion projecting from the lower surface presents two circumferentially oriented bevels, one toward the front and the other toward the rear while the portion projecting from the upper surface forms a cylindrical stud which is engaged in one of the three openings 116 provided in the portion surrounding the central opening of cap 44. The width of each of the openings 116 is slightly greater than the diameter of the corresponding stud in a manner such that the annular cam 114 is maintained in place with peripheral or rotational play in a more or less constant orientation. It is well understood that cam 114 may still slide on the cannon of hour wheel 86 and the bevel protruberances of the cam elements 115 cooperate with lodgings or holes 117 arranged in the surface of wheel 86. Finally, a conducting blade 118 is mounted on an annular planar portion of cam 114 and this conducting blade provides a point obliquely inclined and which extends above the upper surface of the substrate 26 to a location where this substrate bears a conductive track 26a coupled to the electronic chip 135. When the projecting studs 115 are facing holes 117, the cam 114 is displaced downwardly under the effect of the foil spring and the point of blade 118 is brought into contact with the corresponding conductive track. This arrangement thus comprises a switch and since the three studs 115 and the three openings 117 are not arranged at the same distance from the center, they coincide only once per revolution of the hour wheel, that is to say once each twelve hours. It will be noted in this respect that the special arrangement described hereinabove has as advantage to effect a precise and complete engagement of the switch as soon as the rear edge of the openings 117 arrives facing the corresponding bevel of the studs 115. Effectively, in the course of progressive rotation of the hour wheel 86, this wheel has a tendency to drive by friction cam 114 in a manner such that the upper portions of studs 115 bear against the forward edge of opening 116, that is to say the edge situated forwardly in a clockwise sense of rotation. During this operation, the planar surface segment designated by **115*a* in FIG. 9 and which jas a rectangular form, extending between the tops of the two bevelled flanks 115*b* and 115*c*, is in contact with the upper surface of the face of hour wheel 86. However, as soon as the forward edge of the opening 117 has entirely passed under the summit surface 115***a* of studs 115 and arrives opposite the ridge which limits the forward bevel not only are the studs 115 no longer supported by the hour wheel but the pressure of the bias spring of cam 114 has as effect that the bevels bearing on the forward ridge of the openings 117 cause the cam 114 to turn in the counter clockwise sense when it is axially displaced over its entire course. The engagement of the point of blade 118 on a corresponding track of substrate 26 must thus take place abruptly. As has previously been said the grounding of this track cause the transmission of a control signal which switches the date indication displayed on liquid crystal cell 19. Thereafter, the cam 114 is again friction driven with the hour wheel until the upper portions of studs 115 again bear against the edges of the openings 116. From this position on, the action of the rear portion of the ridge of openings 117 on the corresponding bevels of studs 115 brings about an axial displacement of cam 114, which rapidly breaks the contact between blade 118 and the substrate 26 and brings the cam back to the position shown on the drawing where the surfaces 115a of studs 115 rest on the surface of the hour wheel. The symmetric disposition of bevels 115*b* and 115*c* has as effect that the operation of the switch described is the same what ever be the sense of rotation of the hour wheel. Thus when the current time wheel train is set by means of crown 1 brought into a setting position, a pulse is supplied to the circuit at each rotation of the hour wheel adapted as will be well understood so that the firing position corresponds with twelve o'clock of the hours hands. However the electronic circuit will be programmed in a manner such that the switching of the liquid crystal display cell takes place only every other pulse.

The arrangement described hereinabove succeeds thus in concentrating in a limited space all necessary mechanisms for assuring the functions of counting the display of current time in hours, minutes, seconds and dates, and in order to assure counting of measured time intervals to hundredths of a second, the seconds, minutes and hours may to be read continuously on the display means while the fractions of a second, i.e. hundredths of a second in the present case, are displayed only at the end of a counting period. Although in order to assure the chronograph functions, three push pieces 2, 3, 4 have been shown on the drawing, the functions as described may be controlled by means of only two push pieces, the first of which may control the start and the stop and the second the return to zero. However, the arrangement with three push pieces has been provided in order to enable recording of intermediate times and to have them appear as desired. Although these functions do not necessitate any element different from those which have been necessary for standard functions of time measuring and although consequently it has been possible to set aside one of the three push pieces 2, 3, 4 in this description, it may nevertheless be mentioned that with the arrangement of compact and concentrated elements such as described hereinabove, even functions such as the storing in memory and the separate display of intermediate times may be realized. The arrangement enabling placing motors assuring various functions and the printed circuit substrates conducting the control pulses therefor on either side of an intermediate rigid base plate enables the realization of a chronograph timepiece which not only assures the maximum possible reliability in a reduced volume but further is of a construction and assembly which are relatively simple. The arrangement allows particularly that motor 21 driving the wheel train for current time be of relatively low current consumption since it operates constantly. This motor drives a wheel train having considerable demultiplication enabling the realization of friction coupling between the wheel 82 and the center pinion 83 in conditions such that a correction of the time displayed may be effected by means of the stem 90 and crown 1 without disturbing motor 21. The off-center seconds hand 15 is stopped during this operation. Effectively, during time setting all motor feeding is blocked. This operation enables seconds setting of the current time by pressing on the crown 1 at the instant of the time signal.

The radial control elements such as the crown 1 and push pieces 2, 3 and 4 are arranged in the thickness of the movement between the base plate 20 and the wheel train bridge 27. This arrangement facilitates the manufacture of the case since the push pieces are thus to be found between the median plane and the lower surface. It is thus possible, particularly in the case of supplying the arrangement as a wrist-watch, to give the lower portion of the case a bevelled form without disturbing the sealing arrangement for the push pieces and the crown.

What I claim is:

1. A timepiece movement comprising a frame means, at least two stepping motors, an electronic time base, electronic drive signal forming means controlled by the time base and electrical conducting means transmitting drive signals to said motors, said frame means exhibiting two opposed support surfaces each bearing at least one of said motors with said frame means being between said motors, said electrical conducting means being at least partially constituted by tracks formed on first surfaces of two insulating substrates fixed to said frame means, each of said first surfaces being spaced from and facing a respective one of said support surfaces, said support surfaces being located on the two opposed faces of a baseplate constituting a principal element of the frame means, a guide tube secured in a hole in the baseplate, the outer surface of said tube guiding at least one display wheel train member driven by one of said motors and the internal surface of said tube guiding at least one display wheel train member driven by another of said motors.

2. A timepiece movement as set forth in claim 1 wherein the motors located on the opposed support surfaces are at least partially superposed.

3. A timepiece movement as set forth in claim 1 wherein said insulating substrates comprise plates bearing printed conductive tracks and which are fixed at opposite sides of the base plate, said conductive tracks being interconnected by coupling blocks passing through the base plate the ends of which are in contact with the substrate surfaces proximate said base plate.

4. A timepiece movement as set forth in claim 1 arranged as a movement for a chronograph timepiece having an analog display and in which one motor drives a wheel train for counting off current time while a plurality of additional motors drive wheel train means for counting measured time intervals wherein the principal element of the frame means is an intermediate base plate, the motor and corresponding wheel train for counting current time being situated above said base plate while said plurality of motors and wheel train means for counting measured time intervals are situated partially above and partially below said base plate, the wheel trains for counting measured time intervals situated on the base plate having decentered display means.

5. A timepiece movement as set forth in claim 4 wherein the wheel trains for counting measured time intervals include a wheel train for counting hundredths of a second with a central indicating means and wherein the electronic drive signal forming means is arranged to bring said indicating means to its display position following the measurement of a time interval.

6. A timepiece movement as set forth in claim 5 wherein the wheel trains for counting measured time intervals include a seconds counting wheel train with a display means having a hollow shaft lodged in a central guide tube and the central indicating means for hundredths of a second having its shaft lodged in the hollow shaft of the seconds display means, the set of wheel trains for counting seconds and hundredths of seconds with their respective motors being arranged under the base plate.

7. A timepiece as set forth in claim 6 wherein the motors and wheel trains for counting measured time intervals additionally comprise two units mounted on the base plate arranged and adapted to count hours and minutes respectively of said measured time intervals.

8. A timepiece movement as set forth in claim 7 wherein each of said units comprises two frame elements fastened together by two screws one of which fixes one of said insulating substrates to the unit thus maintaining two tracks of said substrate in contact with connection terminals coupling said tracks to the two ends of the motor winding of the respective unit.

9. A timepiece movement as set forth in claim 8 wherein each unit further comprises two screws which fix the stator and core of the motor to one of the elements of the unit frame.

10. A timepiece movement as set forth in claim 5 comprising control means including a control stem arranged to cooperate mechanically with the wheel train for counting current time and three push pieces operating on grounded metal foils which when the push piece is operated come into contact with a track borne on one of said substrates, said stem and said push pieces being disposed about the periphery of the movement.

11. A timepiece movement as set forth in claim 10 wherein said three push pieces cooperate with contact foils adapted to ground a track borne by the upper substrate.

12. A watch movement having an analog display of both current time and measured time intervals, said display having a plurality of display elements, said movement comprising:

a time base;

a plurality of step motors coupled respectively to distinct ones of said display elements;

an electronic device responsive to said time base for generating and applying to said step motors control signals regulated by said time base;

a watch dial, said display elements cooperating with said watch dial to provide an indication of current time and measured time intervals;

a main frame for supporting the mechanism of the watch movement;

a guide tube fixed in said main frame and extending toward said watch dial;

a plurality of coaxial wheel members guided on said guide tube and coupled between said display elements and said step motors;

said plurality of coaxial wheel members comprising two wheel members extending coaxially within said guide tube and coupled, at the side of said main frame opposed with respect to said watch dial, to respective wheel trains driven by two of said plurality of step motors, said two step motors being mounted at the side of said main frame opposed with respect to said watch dial.

13. A watch movement as claimed in claim 12 wherein two of said display elements display seconds and hundredths of seconds of measured time intervals and said wheel members extending coaxially in said guide tube are coupled respectively to said display elements displaying seconds and hundredths of seconds of measured time intervals.

14. A watch movement as claimed in claim 13 and further comprising:

a center wheel frictionally mounted on a center pinion, said center pinion surrounding said guide tube;

a further step motor;

gear means driven by said further step motor for driving said center wheel; and, a further display element mounted on said center pinion and cooperating with said watch dial to display minutes of current time.

15. A watch movement as claimed in claim 14 wherein said further step motor is mounted on the side main frame facing said watch dial.

16. A watch movement as claimed in claim 14 and further comprising:

an hour wheel mounted for rotation about the axis of said guide tube;

an hours display element mounted on the canon of said hour wheel and cooperating with said watch dial to display hours of current time; and a minute wheel driven by said center pinion for driving said hour wheel.

17. A watch movement as claimed in claim 16 and further comprising:

a digital date display;

a drive signal forming means for applying electrical drive signals to said digital date display; and, switch means controlled by said hour wheel for actuating said drive signal forming means.

18. A watch movement as claimed in claim 17 wherein said switch means includes cam means comprising a ring having protuberances with bevelled flanks bearing on said hour wheel and maintained with peripheral play in a fixed orientation, said hour wheel having recesses corresponding to said protuberances and said cam means bearing a contact blade which is axially displaced by engagement of said protuberances in said recesses to thereby actuate said drive signal forming means.

19. A watch movement as claimed in claim 12 wherein the wheel trains for counting measured time intervals includes a wheel train for counting hundredths of a second with a central indicating means, and drive signal forming means for bringing said indicating means to its display position following the measurement of a time interval.

20. A watch movement as claimed in claim 12 wherein the outer one of said wheel members coaxially extending within said guide tube comprises a first bearing surface in contact with a small portion of the wall of said guide tube immediately proximate to the end of said guide tube opposite to said main frame, and wherein the inner one of said wheel members coaxially extending within said guide tube comprises a second bearing surface in contact with the inner wall of said outer one of said wheel members, said second bearing surface being located between said first bearing surface and the end of said outer one of said wheel member proximate said opposite end of said guide tube.

* * * * *